United States Patent [19]

Wernicke et al.

[11] 4,276,372

[45] Jun. 30, 1981

[54] PHOTOGRAPHIC MATERIAL WITH INTERIMAGE EFFECT

[75] Inventors: Ubbo Wernicke, Odenthal; Reinhart Matejec; Franz Moll, both of Leverkusen, all of Fed. Rep. of Germany

[73] Assignee: AGFA-Gevaert, A.G., Leverkusen, Fed. Rep. of Germany

[21] Appl. No.: 120,332

[22] Filed: Feb. 11, 1980

Related U.S. Application Data

[63] Continuation of Ser. No. 898,626, Apr. 21, 1978, abandoned.

[30] Foreign Application Priority Data

Dec. 29, 1977 [DE] Fed. Rep. of Germany ..... 2718437

[51] Int. Cl.[3] ..... G03C 1/76

[52] U.S. Cl. ..... 430/505; 430/362; 430/379; 430/382; 430/544; 430/571

[58] Field of Search ..... 430/505, 544, 571, 362, 430/382

[56] References Cited

U.S. PATENT DOCUMENTS

| | | | |
|---|---|---|---|
| 2,231,684 | 2/1941 | Schinzel | 430/507 |
| 2,318,597 | 5/1943 | Davey et al. | 430/571 |
| 3,140,179 | 7/1964 | Russell | 430/506 |
| 3,779,764 | 12/1973 | Moll et al. | 430/509 |
| 4,046,576 | 9/1977 | Terwilliger et al. | 430/569 |
| 4,082,553 | 4/1978 | Groet | 430/505 |

*Primary Examiner*—Travis Brown
*Attorney, Agent, or Firm*—Connolly & Hutz

[57] ABSTRACT

A color photographic material is provided in which the interimage effect is adjusted to provide optimum color reproduction. The photographic material comprises an emulsion referred to as type I emulsion, which releases an inhibitor on development and another emulsion with underripened grains which are more soluble than those of the type I emulsion.

14 Claims, No Drawings

PHOTOGRAPHIC MATERIAL WITH INTERIMAGE EFFECT

CROSS-REFERENCE TO PARENT APPLICATION

This application is a continuation of pending application Ser. No. 898,626 filed Apr. 21, 1978 for Photographic Material With Interimage Effect, now abandoned.

This invention relates to a colour photographic recording material having at least two silver halide emulsion layers, in which the interimage effect is adjusted to provide optimum colour reproduction. The invention relates more particularly to a suitable colour photographic reversal material.

It is already known to make use of the interimage effect to improve the sensitometric properties of photographic material. Reference may be made in this connection, for example, to the article by C. R. Barr in "Photographic Science and Engineering" 13 (1969), pages 74 et seq.

It is also known that interimage effects are liable to occur when inhibitors diffuse from an exposed (releasing) layer into an adjacent layer where they influence the development of this layer. According to German Offenlegungsschrift No. 2,615,344, this effect is enhanced by adding completely fogged emulsion portions to the layer which is influenced by the inhibitors.

It has been found, however, that the interimage effect cannot always be kept within the desired limits in the known photographic materials. If the interimage effect is too small, the colour reproduction obtained is poor. On the other hand, in certain photographic materials the interimage effect may be too great so that the reproduction of light colour tones, e.g. skin colour, is excessively falsified, especially where the colour densities are low.

It is therefore an object of the present invention to provide a colour photographic recording material in which the interimage effect can be adjusted to the desired intensity so that optimum colour reproduction is ensured.

It has now been found that the interimage effect can be effectively controlled in photographic materials if, in addition to emulsions which release the inhibitors, hereinafter referred to as type I emulsions, other emulsions, hereinafter referred to as type II emulsions are used which differ from type I and are characterised in that their silver halide grains are more readily soluble than those of the type I emulsion and are underripened.

The invention thus relates to a photographic material having at least two silver halide emulsion layers which are sensitive to different regions of the spectrum, in which at least one silver halide emulsion layer contains a type I emulsion and at least one silver halide emulsion layer contains a type II emulsion, and the inhibitors released on development of the photographic material inhibit the development of the type II emulsion.

The emulsions are prepared according to the known methods of precipitating silver halide in a binder and are flocculated and washed to remove unwanted salts.

Silver halide emulsions of type I may be prepared, for example, as described in Glafkides, "Photographic Chemistry", Vol 1, pages 298 et seq, Fountain Press, London 1958 and ripened to maximum sensitivity with minimum fogging. Suitable type I emulsions contain from 1 to 10 mol%, preferably from 4 to 8 mol %, of iodide.

Type II silver halide emulsions suitable for the material according to the invention include silver chloride, silver chlorobromide and silver bromide emulsions with an iodide content of up to 6 mol %, preferably up to 3 mol %.

The emulsion grains of the type II emulsion must be more readily soluble in the first reversal developer, which generally contains complex formers for silver ions, than the emulsion grains of the type I emulsion. This higher solubility of the emulsion grains of type II may be obtained, for example, by the following measures:

(a) The type I emulsion contains a greater concentration of silver iodide than the type II emulsion, especially when both the type I and the type II emulsions are silver iodobromide emulsions, and/or (b) the type I emulsion contains more silver iodide (in mol) and in addition silver bromide (in mol) than the type II emulsion, especially when other silver salts are present, for example silver chloride, and/or (c) the silver halide grains in type II emulsion have a smaller average grain diameter than the grains of the type I emulsion.

Type II silver halide emulsions which are suitable for the material according to the invention are underripened.

By "Underripened emulsions" are meant emulsions which have not been ripened to their full sensitivity. Ripening is stopped prematurely so that the full sensitivity, which is easily obtained if ripening is carried out for the usual lengths of time, is not reached. If desired, chemical ripening may be dispensed with altogether. If, therefore, ripening were not stopped prematurely as indicated above but continued for the usual length of time, the sensitivity of the resulting emulsion would inevitably be higher. Ripening of the type II emulsion may be carried out in the presence of the usual gold compounds but may be carried out in the absence of such compounds too.

Since ripening of the type II emulsions is not carried to the stage of full sensitivity, which is desirable in other emulsions, the fogging of type II emulsion is comparatively slight. The degree of ripening or underripening of the type II emulsion is characterised by the degree of fogging defined below.

The degree of fogging of the type II emulsion is at most 25%, preferably not more than 10%, and is determined after the emulsion has been applied to a substrate layer and developed for 6 minutes at 30° C. in an aqueous developer containing, per liter, 2 g of ethylene diaminotetracetic acid, 0.3 g of 1-phenyl-3-pyrazolidone, 50 g of sodium sulphite, 6 g of hydroquinone, 35 g of sodium carbonate, 2.5 g of potassium thiocyanate, 2 g of potassium bromide and 0.015 g of potassium iodide. The degree of fogging is defined by the quantity of silver, calculated as silver nitrate and multiplied by 100, situated on this material after this development and the usual fixing, divided by the quantity of silver, calculated as silver nitrate, situated on this material before development.

Type II emulsions which have been ripened to their full sensitivity, as is usual, would have a degree of fogging of at least 35%, preferably at least 40%, under the given conditions.

According to the invention, the interimage effect can be enhanced and/or attenuated according to the quantity and arrangement of the type II emulsion in the combination of layers.

For example, if the colour densities are low, undesirable interimage effects which falsify the reproduction of light colour tones may occur, especially if emulsions with a high iodide content are used in all of the emulsion layers and the development times are prolonged. Such undesirable interimage effects may be reduced according to the invention by inserting layers of type II emulsions which are free from colour couplers, to which white couplers may be added, between those layers between which the interimage effect is to be reduced.

According to the invention, emulsions which are sensitive to the same region of the spectrum may also be arranged in different emulsion layers, one layer of the emulsion then containing the type I emulsion and the other layer the type II emulsion. Moreover, at least one emulsion layer may contain a mixture of emulsions of type I and type II both sensitive to the same region of the spectrum.

In certain cases, it may be advantageous to mix spectrally unsensitized type II emulsions with spectrally sensitized type I emulsions.

Both the type I emulsion layers and the type II emulsion layers may contain colour couplers and/or white couplers.

The material prepared according to the invention may be developed with the usual colour developer substances, e.g. the following:

N.N-Dimethyl-p-phenylenediamine;
4-amino-3-methyl-N-ethyl-N-methoxyethylaniline;
monomethyl-p-phenylenediamine;
2-amino-5-diethylaminotoluene;
N-butyl-N-ω-sulphobutyl-p-phenylenediamine;
2-amino-5-(N-ethyl-N-β-methanesulphonamidoethylamino)-toluene;
N-ethyl-N-β-hydroxyethyl-p-phenylenediamine;
N-N,bis-(β-hydroxyethyl)-p-phenylenediamine and
2-amino-5-(N-ethyl-N-β-hydroxyethylamino)-toluene Other suitable colour developers have been described, for example, in J. Amer.Chem. Soc. 73, 3100 (1951).

The photographic material prepared according to the invention may contain the usual colour couplers, generally incorporated in the silver halide layers. Thus, the red sensitive layer may contain, for example, a non-diffusible colour coupler for the production of the cyan partial colour image, generally a phenol or α-naphthol coupler; the green sensitive layer contains at least one non-diffusible colour coupler for producing the magenta partial colour image, normally a colour coupler based on 5-pyrazolone or indazolone; the blue sensitive layer unit contains at least one non-diffusible colour coupler for the production of the yellow partial colour image, generally a colour coupler containing an open-chained keto methylene group. Large numbers of colour couplers of this kind are known and have been described in numerous Patent Specifications. As example, may be mentioned the publication "Farbkuppler" by W. Pelz in "Mitteilungen aus den Forschungslaboratorien der Agfa, Leverkusen/München", Volume III (1961) and K. Venkataraman in "The Chemistry of Synthetic Dyes", Vol. 4, 341 to 387, Academic Press 1971.

The non-diffusible colour couplers used may be 2-equivalent couplers. These contain a removable substituent in the coupling position, so that they require only two equivalents of silver halide to produce the colour, in contrast to the usual 4-equivalent couplers. Suitable 2-equivalent couplers include, for example, the known DIR couplers, in which the removable group is released as diffusible development inhibitor after reacting with colour developer oxidation products. So-called white couplers may also be used to improve the properties of the photographic material.

The non-diffusible colour couplers and colour producing compounds are added to the light-sensitive silver halide emulsions or other casting solutions by the usual, known methods. If the compounds are soluble in water or alkali, they may be added to the emulsions in the form of aqueous solutions, to which water-miscible organic solvents such as ethanol, acetone or dimethylformamide may be added. If the non-diffusible colour couplers or colour producing compounds are insoluble in water of alkalies, they may be emulsified in known manner, for example a solution of these compounds in a low boiling organic solvent may be mixed directely with the silver halide emulsion or first mixed with an aqueous gelatine solution, the organic solvent then being removed in the usual manner. The resulting emulsion of the given compound in gelatine is then mixed with the silver halide emulsion. So-called coupler solvents or oil formers may also be added for emulsifying such hydrophobic compounds. These coupler solvents or oil formers are generally higher boiling organic compounds which enclose, in the form of oily droplets, the non-diffusible colour couplers and development inhibitor releasing compounds which are required to be emulsified in the silver halide emulsions. Information on this may be found, for example, in U.S. Pat. Nos. 2,322,027; 2,533,514; 3,689,271; 3,764,336 and 3,765,897.

The binder used for the photographic layers is preferably gelatine but this may be completely or partly replaced by other natural or synthetic binders. Suitable natural binders include e.g. alginic acid and its derivatives such as its salts, esters or amides, cellulose derivatives such as carboxymethylcellulose, alkylcelluloses, such as hydroxyethylcellulose, starch or its derivatives such as ethers or esters, or carrageenates. Polyvinyl alcohol, partially saponified polyvinyl acetate and polyvinyl pyrrolidone are suitable synthetic binders.

The emulsions may also be chemically sensitized, e.g. by the addition of sulphur compounds such as allyl isothiocyanate, allylthiourea or sodium thiosulphate at the chemical ripening stage. Reducing agents may also be used as chemical sensitizers, e.g. the tin compounds described in Belgian Pat. Nos. 493,464 and 568,687; polyamines such as diethylene triamine or aminomethyl sulphinic acid derivatives, e.g. according to Belgian Pat. No. 547,323.

Noble metals such as gold, platinum, palladium iridium, ruthenium or rhodium and compounds of these metals are also suitable chemical sensitizers. This method of chemical sensitization has been described in the article by R. Koslowsky, Z. Wiss.Phot. 46, 65–72 (1951).

The emulsions may also be sensitized with polyalkylene oxide derivatives, e.g. with a polyethylene oxide having a molecular weight of between 1000 and 20,000, or with condensation products of alkylene oxides and aliphatic alcohols, glycols or cyclic dehydration products of hexitols, or with alkyl substituted phenols, aliphatic carboxylic acids, aliphatic amines or aliphatic diamines and amides. The condensation products should have a molecular weight of at least 700, preferably more than 1000. These sensitizers may, of course, also be combined to produce special effects, as described in Belgian Pat. No. 537,278 and in British Pat. No. 727,982.

The emulsions may also be optically sensitized, e.g. with the usual polymethine dyes such as neutrocyanines, basic or acid carbocyanines, rhodacyanines, hemicyanines, styryl dyes or oxonoles. Sensitizers of this type have been described in the work by F. M. Hamer "The Cyanine Dyes and related compounds", (1964).

The emulsions, especially the emulsions of type I, may contain the usual stabilizers, e.g. homopolar or salt compounds of mercury containing aromatic or heterocyclic rings, such as mercaptotriazoles, or simple mercury salts, sulphonium mercury double salts and other mercury compounds. Azaindenes are also suitable stabilizers, particularly tetra-and penta-azaindenes and especially those which are substituted with hydroxyl or amino groups. Compounds of this type have been described in the article by Birr. Z. Wiss.Phot. 47 (1952), 2 to 58. Other suitable stabilizers include heterocyclic mercapto compounds, e.g. phenylmercaptotetrazole, quaternary benzothiazole derivatives and benzotriazole.

The type II emulsions may, of course, also contain certain quantities of these stabilizers, but they must not impair the important properties of the type II emulsions. In particular, melting of the type II emulsions for the preparation of the casting solutions may be carried out in the presence of stabilizers of the triazaindolizine type or stabilizers having a comparable action.

The emulsions may be hardened in the usual manner, for example with formaldehyde or halogen substituted aldehydes which contain a carboxyl group, such as mucobromic acid, diketones, methane sulphonic acid estes or dialdehydes.

The photographic layers may also be hardened with epoxide, heterocylic ethylene imine or acryloyl hardeners. Examples of such hardeners have been described, for example, in German Offenlegungsschrift No. 2,263,602 or in British Pat. No. 1,266,655. The layers may also be hardened by the process according to German Offenlegungsschrift No. 2,218,009 to produce colour photographic materials which are suitable for high temperature processing.

The photographic layers or colour photographic multilayered materials may also be hardened with diazine, triazine or 1,2-dihydroquinoline hardeners as described in British Pat. Nos. 1,193,290; 1,251,091; 1,306,544 and 1,266,655; French Pat. No. 7,102,716 and British Pat. No. 1,452,669. Examples of such hardeners include diazine derivatives containing alkylsulphonyl or arylsulphonyl groups, derivatives of hydrogenated diazine or triazines, e.g. 1,3,5-hexahydrotriazine, fluoro-substituted diazine derivatives, e.g. fluoropyrimidine, and esters of 2-substituted 1,2-dihydroquinoline- or 1,2-dihydroisoquinoline-N-carboxylic acids. Vinyl sulphonic acid hardeners and carbodiimide and carbamoyl hardeners may also be used, e.g. those described in German Offenlegungsschrift Nos. 2,263,602; 2,225,230 and 1,808,685; French Pat. No. 1,491,807; German Federal Pat. No. 872,153 and DDR Pat. No. 7218. Other suitable hardeners have been described, for example, in British Pat. No. 1,268,550.

The advantages of using a material according to the invention in which fogging of the emulsion which is required to be inhibited is kept as low as possible are all the more surprising in view of the fact that it has been found, for example according to German Offenlegungsschrift No. 2,615,344, that the interimage effect is reinforced if the emulsion layer which is to be inhibited has been prefogged by the addition of a maximally fogged emulsion.

The development inhibitors released from the type I emulsion may, for example, be iodide ions, heterocyclic compounds containing sulphur and/or nitrogen, or other inhibitors.

The following Examples serve to explain the invention without restricting the invention to the embodiments given in the Examples.

EXAMPLES

The emulsions used in the following Examples are prepared as follows:

1. Type I silver iodobromide emulsion

A silver iodobromide emulsion containing 6 mol % of iodide is prepared according to Glafkides "Photographic Chemistry", Vol. 1, page 289 et seq.

2. Type II silver bromide emulsion

A silver bromide emulsion is prepared by the process described by Glafkides in "Photographic Chemistry", Vol. 1, pages 289 et seq, Fountain Press, London 1958. In this process, silver nitrate is added to a solution containing gelatine and potassium bromide. The emulsion is then flocculated and washed and redissolved by raising the pH. The quantity of gelatine added to the solution is calculated so that the ratio of silver nitrate to gelatine is 1.0 and the solution contains 115 g of silver (calculated as silver nitrate) per kg of emulsion.

The emulsions are ripened in known manner by the addition of sulphur ripening particles and gold-I compounds.

The following three samples are removed during the ripening process:

Sample 1/1 At half the ripening time required for obtaining maximum sensitivity of the emulsion;

Sample ½ on reaching maximum sensitivity of the emulsion;

Sample ⅓ after a ripening time 50% longer than that used for sample ½.

To determine the sensitometric properties of these emulsions, the individual samples are cast on a suitable substrate after 35 ml of a 1% aqueous solution of 4-hydroxy-6-methyl-1,3,3*a*, 7-tetraazaindene, 35 ml of a 7.5% aqueous solution of saponin and 35 ml of a 2% aqueous solution of mucochloric acid have been added per liter of the samples of emulsion.

The individual emulsion samples are characterised by their degree of fogging after 6 minutes' development at 30° C. in the developer described below. The emulsion layers are not exposed for this purpose. The degree of fogging is determined by measuring the silver content before development and after development and fixing, the silver values being converted to silver nitrate in each case. In this process, the degree of fogging is defined as:

$$\frac{AgNO_3 \text{ (after development and fixing)}}{AgNO_3 \text{ (before development)}} \cdot 100.$$

The developer used for determining fogging has the following composition per liter:

| | |
|---|---|
| Distilled water | 300 ml |
| Ethylene diaminetetracetic acid | 2.0 g |
| 1-phenyl-3-pyrazolidine | 0.3 g |
| Sodium sulphite (anhydrous) | 50.0 g |

-continued

| | |
|---|---|
| Hydroquinone | 6.0 g |
| Sodium carbonate (anhydrous) | 35.0 g |
| Potassium thiocyanate | 2.5 g |
| Potassium bromide | 2.0 g |
| Potassium iodide | 0.015 g |
| made up with water to 1000 ml | |
| pH = 10. | |

The following degrees of fogging are obtained after development followed by the usual processing:

| Sample | Degree of fogging |
|---|---|
| 1/1 | 8% |
| 1/2 | 45% |
| 1/3 | 71% |

3. Type II silver iodobromide emulsion

A silver iodobromide emulsion is prepared as described above for the preparation of a type II silver bromide emulsion, but in this case the silver halide contains 2 mol % of iodide. Three samples are again removed during chemical ripening:

Sample 2/1 At half the ripening time required for obtaining maximum sensitivity;

Sample 2/2 On reaching maximum sensitivity;

Sample 2/3 at a ripening time 50% longer than that used for sample 2/2.

Again, as described above for the type II silver bromide emulsion, samples 2/1, 2/2 and 2/3 are characterised by their degree of fogging after development and processing.

The following values are obtained.

| Sample | Degree of fogging |
|---|---|
| 2/1 | 9% |
| 2/2 | 42% |
| 2/3 | 85% |

EXAMPLE 1

The following layers are applied one after another to a layer substrate of cellulose triacetate containing an anti-halation layer of black colloidal silver:

(a) A cyan layer containing the type I emulsion described above which has been sensitized to the red spectral region and a colour coupler corresponding to the following formula

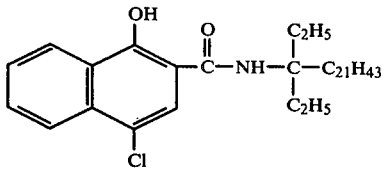

(silver application corresponding to 1.5 g of silver nitrate/m²)

(b) Magenta layer containing a type II emulsion described above which has been sensitized to the green spectral region and a colour coupler corresponding to the following formula

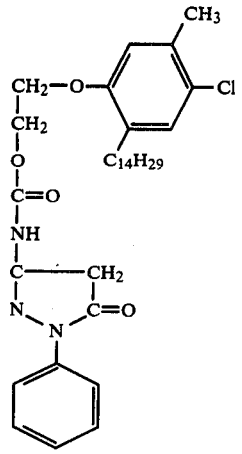

(silver application corresponding 1.0 g of silver nitrate/m²)

(c) Yellow filter layer of a silver sol (d) Yellow layer containing the type I emulsion described, which is sensitive to the blue spectral region, and a colour coupler corresponding to the following formula:

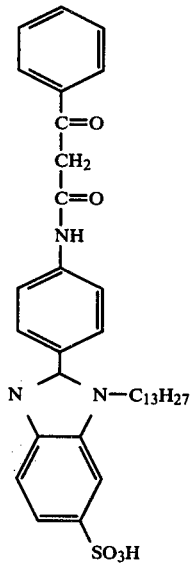

(silver application corresponding to 2 g of silver nitrate/m²)

(h) Protective gelatine layer (thickness 0.5μ).

Table 1 summarizes the types of emulsion and emulsion samples used in the layer arrangements of Example 1.

The following process is used for comparing the interimage effects obtained by processing these layer arrangements:

The photographic material is exposed to red monochromatic light through a step wedge. The photographic material is also exposed to monochromatic green light, the quantity of this green light being calculated so that, when the photographic material has been processed, approximately half of the maximum colour density is obtained in the magenta layer which is sensitized to green light.

After exposure, the photographic material is processed as follows:

Black-and-white development:

6 minutes at 30° C. in a developer consisting of:

| | |
|---|---|
| Distilled water | 300 ml |
| Ethylene diaminetetracetic acid | 2.0 g |
| 1-Phenyl-3-pyrazolidone | 0.3 g |
| Sodium sulphite (anhydrous) | 50.0 g |
| Hydroquinone | 6.0 g |
| Sodium carbonate (anhydrous) | 35.0 g |
| Potassium thiocyanate | 2.5 g |
| Potassium bromide | 2.0 g |
| Potassium iodide | 0.015 g |

made up with water to 1000 ml pH=10

Short stop bath:

5 minutes in a solution of

| | |
|---|---|
| Distilled water | 300 ml |
| Sodium acetate (cryst.) | 30 g |
| Acetic acid | 5 ml |

made up with water to 1000 ml pH=5

Washing: 10 minutes

Diffuse reversal exposure: 2 minutes

Colour development: 6 minutes in a colour developer consisting of:

| | |
|---|---|
| Distilled water | 300 ml |
| Nitrilotriacetic acid | 2 g |
| Trisodium phosphate | 20 g |
| 4-Amino-3-methyl-N-ethyl-N-(β-hydroxyethyl)-aniline | 6 g |
| Potassium bromide | 2.0 g |
| Hydroxylamine | 1.2 g |
| Sodium sulphite | 5.0 g |

made up with water to 1000 ml, pH=11.7.

Washing: 10 minutes.

Bleaching bath: 5 minutes in a bleaching bath consisting of:

| | |
|---|---|
| Potassium ferricyanide | 80 g |
| Potassium bromide | 20 g |
| Disodium phosphate | 12 g |

made up with water to 1000 ml and adjusted to pH=5.2 with acetic acid.

Washing: 5 minutes.

Fixing: 5 minutes in a fixing bath consisting of:

| | |
|---|---|
| Ammonium thiosulphate | 150 g |
| Sodium sulphite (anhydrous) | 10 g |
| Sodium hexametaphosphate | 2 g |

made up with water to 1000 ml, pH=7.

Final washing: 5 minutes

To assess the materials sensitometrically, the colour densities obtained after the above described exposure and processing are determined depending upon the intensity of exposure. Where no interimage effect occurs, the colour density in the magenta layer, which has not been exposed through a step wedge but has been exposed homogeneously, is independent of the colour density of the other layers. If an interimage effect occurs, a gradation builds up (counter gradation) in a layer arrangement according to Example 1. This magenta gradation runs counter to the colour density curve of the cyan layer which influences the magenta layer. The gradient of the magenta counter-gradation is a measure of the intensity of the inter-image effect. The magenta counter-gradations obtained in the various arrangements of layers after the processing described above are shown in the following Table 1.

A layer arrangement (arrangement 7, comparison a) which differs from the arrangements described above only in that type I emulsion are used exclusively in all the layers is prepared for comparison. For further comparison, a sample of a type I emulsion is completely prefogged by intensive preliminary exposure (5 minutes vigorous stirring of the emulsion in daylight) according to German Offenlegungsschrift No. 2,615,344 and mixed with 9 parts of a type I emulsion which has not been prefogged, and then used in this form in the magenta layer of layer arrangement 7 (layer arrangement 8, comparison b).

TABLE 1

Interimage effect in the layer arrangements according to Example 1

| Layer arrangement | Emulsion in the: Cyan layer | Magenta layer | Yellow layer | Magenta counter-gradation |
|---|---|---|---|---|
| 1 | Type I | Type II, Sample 1/1 | Type I | 0.32 |
| 2 | " | Sample 1/2 | " | 0.28 |
| 3 | " | Sample 1/3 | " | 0.20 |
| 4 | " | Sample 2/1 | " | 0.30 |
| 5 | " | Sample 2/2 | " | 0.24 |
| 6 | " | Sample 2/3 | " | 0.19 |
| 7 (comparison a) | " | Type I | " | 0.05 |
| 8 (comparison b) | " | Type I + Type I prefogged | " | 0.10 |

All of the layer arrangements containing the type II emulsion, which is more easily soluble than the type I emulsion, in the magenta layer produce a much more powerful interimage effect than those layer arrangements which contain a type I emulsion in the magenta layer (layer arrangement 7, comparison a; layer arrangement 8, comparison b). According to the invention, a particularly powerful interimage effect is obtained when the type II emulsion is as little fogged as possible. Thus in the layer arrangements 1 to 3, as also in the layer arrangements 4 to 6, the interimage effect in the magenta layer, characterised by the magnitude of the magenta counter-gradation, increases with decreasing degree of fogging of the type II emulsion.

EXAMPLE 2

The type I emulsion used in Example 2 is the type I emulsion described in Example 1, and the type II emulsion used is the emulsion sample referred as 1/1 in Example 1.

Layer arrangement

The following layers are applied one after another to a substrate layer as described in Example 1:

(a) A magenta layer containing the described type II emulsion which is sensitized to the green spectral region and a colour coupler corresponding to the following formula

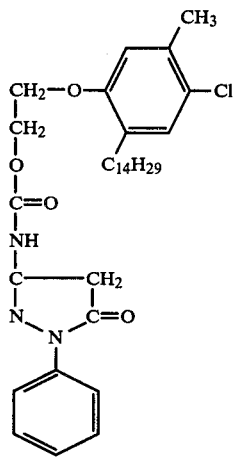

(silver application corresponding to 0.6 g of silver nitrate/m$^2$).

(b) A cyan layer containing a type I emulsion which is sensitized to the red spectral region and a colour coupler corresponding to the following formula

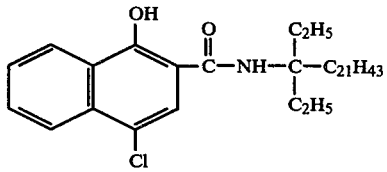

(silver application corresponding to 1.0 g of silver nitrate/m$^2$)

(c) Gelatin intermediate layer, thickness: 0.5$\mu$.

(d) A magenta layer containing the type I emulsion. Layer (d) is similar to layer (a) of the present Example 2 except that the type I emulsion is used instead of the type II emulsion and the silver application is lower by 30%.

(e) A cyan layer containing the type II emulsion. Layer (e) is similar to layer (b) of this Example except that the type II emulsion is used instead of the type I emulsion. (silver application corresponding to 0.7 g of silver nitrate/m$^2$)

(f) Yellow filter layer of a silver sol (yellow density 0.7).

(g) A yellow layer containing the described type I emulsion which is sensitive to the blue spectral region and a colour coupler corresponding to the following formula

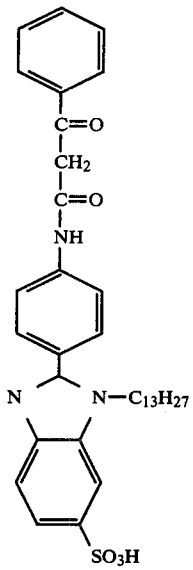

(silver application corresponding to 2 g of silver nitrate/m$^2$).

(h) Protective gelatine layer (thickness of 0.5$\mu$).

If desired, white couplers or filter dyes may be incorporated with layer (c). Additional intermediate layers containing compounds which are capable of intercepting developer oxidation products, e.g. white couplers and, optionally filter dyes in addition to the binder may be used between individual colour layers to prevent stray coupling reactions.

For a comparison with the arrangement of layers described in Example 2, a similar arrangement is used which does not contain layers (a) and (e), in other words it contains only type I emulsions. In order to obtain the same colour densities in this comparison arrangement, the silver application in layer (b) is increased to an amount corresponding to 1.5 g of silver nitrate/m$^2$ and the silver application of layer (d) to an amount corresponding to 1.0 g of silver nitrate/m$^2$).

PROCESSING

Processing is carried out in basically the same way as described in Example 1. The photographic recording material is exposed to monochromatic blue light through a step wedge and is exposed homogeneously, in other words without a step wedge, to monochromatic red and green light.

Subsequent processing of the experimental material is carried out as described in Example 1. The following results are obtained from a sensitometric assessment:

| | Example 2 | Comparison |
|---|---|---|
| Magenta counter-gradation | 0.24 | 0.05 |
| Cyan counter-gradation | 0.23 | 0.07 |

It is shown that in the layer arrangement according to the invention, a powerful interimage effect can be obtained both in the magenta layer and in the cyan layer.

EXAMPLE 3

The following layers are applied one after another on a substrate layer according to Example 1:

(a) A cyan layer corresponding to layer (b) of Example 2 with a silver application corresponding to 1.5 g of silver nitrate/$m^2$.

(b) An intermediate gelatine layer similar to layer (c) of Example 2.

(c) A magenta layer consisting of a mixture of the casting solutions for layers (a) and (d) of Example 2, in which (a) and (d) are mixed in proportions of 2:1 and the silver application corresponds to 1.5 g of silver nitrate/$m^2$. Layers (f), (g) and (h) of Example 2 are then applied in the given sequence.

The comparison arrangement described in Example 2 is used for comparison.

Exposure and processing of the photographic material according to Example 3 are carried out as described in Example 1.

The following results are obtained:

| | Example | Comparison |
|---|---|---|
| Magenta counter-gradation | 0.16 | 0.05 |

This again shows that the material according to the invention has a distinctly more pronounced interimage effect than the comparison material.

We claim:

1. Photographic recording material consisting of a layer substrate and at least two silver halide emulsion layers which are sensitive to different regions of the visible spectrum, at least one of which layers contains a silver halide emulsion, hereinafter referred to as type I silver halide emulsion, which releases a development inhibitor on development of the photographic material, and at least one of which layers contains a silver halide emulsion, hereinafter referred to as type II silver halide emulsion, which is capable of being inhibited by the aforesaid inhibitor, wherein the emulsion grains of the type II silver halide emulsion are more easily soluble than the emulsion grains of the type I emulsion and the type II emulsion is not ripened to full sensitivity whereby after its application to a layer substrate and 6 minutes' development at 30° C. in an aqueous developer containing, per liter, 2 g of ethylene diaminotetracetic acid, 0.3 g of 1-phenyl-3-pyrazolidone, 50 g of sodium sulphite, 6 g of hydroquinone, 35 g of sodium carbonate, 215 g of potassium thiocyanate, 2 g of potassium bromide and 0.015 g of potassium iodide, it has a degree of fogging of at the most 25%, the degree of fogging being defined by the quantity of silver, calculated as silver nitrate, and multiplied by 100, situated on the layer substrate after development and fixing divided by the quantity of silver, calculated as silver nitrate, situated on the layer substrate before development.

2. Photographic material according to claim 1, wherein the type I emulsion contains more silver iodide than the type II emulsion.

3. Photographic material according to claim 1, wherein the type I emulsion contains more silver iodide in addition to silver bromide than the type II emulsion.

4. Photographic material according to claim 1, wherein the average grain diameter of the silver halide grains of the type II emulsion is smaller than the average grain diameter of the silver halide grains of the type I emulsion.

5. Photographic recording material according to claim 1, wherein at least one of the silver halide emulsion layers contains a coupler which produces a dye or a white coupler.

6. Photographic recording material according to claim 1, wherein it is a recording material for the production of reversal images.

7. Photographic recording material according to claim 1, wherein at least one of the type I emulsions has an iodide content of from 1 to 10 mol %.

8. Photographic recording material according to claim 1 wherein at least one of the type II emulsions has an iodide content of from 0 to 6 mol %.

9. Photographic recording material according to claim 1 wherein at least one of the type I emulsions has an iodide content of from 4 to 8 mol %.

10. Photographic recording material according to claim 1, wherein at least one of the type II emulsions has an iodide content of from 0 to 3 mol %.

11. Photographic recording material according to claim 1, wherein the degree of fogging of the type II emulsion is at the most 10%.

12. Photographic recording material according to claim 1, wherein the type I emulsions and type II emulsions are contained in separate silver halide emulsion layers.

13. Photographic recording material according to claim 1, wherein the type I silver halide emulsions and the type II silver halide emulsions are present in the same emulsion layer.

14. Photographic recording material according to claim 1, wherein the type I silver halide emulsions and the type II silver halide emulsions are present both in separate silver halide emulsion layers and in the same silver halide emulsion layer.

* * * * *